US011085355B2

(12) United States Patent
Lee

(10) Patent No.: US 11,085,355 B2
(45) Date of Patent: Aug. 10, 2021

(54) COOLANT PUMP, COOLING SYSTEM PROVIDED WITH THE SAME FOR VEHICLE AND CONTROL METHOD FOR THE SAME

(71) Applicants: Hyundai Motor Company, Seoul (KR); KIA Motors Corporation, Seoul (KR)

(72) Inventor: Hyo Jo Lee, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 263 days.

(21) Appl. No.: 16/193,441

(22) Filed: Nov. 16, 2018

(65) Prior Publication Data

US 2020/0040803 A1 Feb. 6, 2020

(30) Foreign Application Priority Data

Aug. 3, 2018 (KR) ..... 10-2018-0090816

(51) Int. Cl.

| | |
|---|---|
| ***F01P 7/16*** | (2006.01) |
| ***F01P 5/12*** | (2006.01) |
| ***F04D 13/02*** | (2006.01) |
| ***F01P 3/02*** | (2006.01) |
| *F01P 7/14* | (2006.01) |

(52) U.S. Cl.

CPC ..... *F01P 7/16* (2013.01); *F01P 3/02* (2013.01); *F01P 5/12* (2013.01); *F04D 13/02* (2013.01); *F01P 2007/146* (2013.01)

(58) Field of Classification Search

CPC ..... F01P 7/16; F01P 5/12; F01P 3/02; F01P 2007/146; F01P 7/161; F04D 13/02; F04D 15/0038; F04D 29/426; F04D 29/445; F04D 29/447; F04D 29/468; F04D 29/628; F04D 29/46; F04D 29/466

USPC ..... 415/127

See application file for complete search history.

(56) References Cited

U.S. PATENT DOCUMENTS

| | | | | |
|---|---|---|---|---|
| 3,385,224 A * | 5/1968 | Hermann | F04D 15/0016 | 417/423.11 |
| 3,784,318 A * | 1/1974 | Davis | F04D 29/468 | 415/158 |
| 4,527,949 A * | 7/1985 | Kirtland | F01D 17/143 | 415/150 |
| 4,752,183 A * | 6/1988 | Sakurai | F04D 29/042 | 415/12 |
| 4,802,817 A * | 2/1989 | Tyler | F04D 15/0022 | 415/157 |
| 4,828,455 A * | 5/1989 | Kinbara | F01P 5/10 | 123/41.44 |

(Continued)

FOREIGN PATENT DOCUMENTS

WO WO-2017124198 A1 * 7/2017 ..... F04D 29/468

*Primary Examiner* — Hung Q Nguyen
(74) *Attorney, Agent, or Firm* — Brinks Gilson & Lione

(57) ABSTRACT

A coolant pump for a vehicle includes an impeller mounted at one side of a shaft and configured for pumping a coolant, a pulley mounted at the other side of the shaft and configured for receiving a torque, a pump housing including an inlet for allowing the coolant to flow in and an outlet for allowing the coolant to flow out, a shroud disposed within the pump housing for selectively closing or opening the outlet and an operation portion selectively moving the shroud.

5 Claims, 10 Drawing Sheets

(56) References Cited

U.S. PATENT DOCUMENTS

| | | | | |
|---|---|---|---|---|
| 5,169,286 | A * | 12/1992 | Yamada | F01P 5/10 277/558 |
| 6,431,823 | B1 * | 8/2002 | Slepoy | F04D 15/0027 415/126 |
| 9,528,521 | B2 * | 12/2016 | Pawellek | F04D 13/14 |
| 10,662,961 | B2 * | 5/2020 | Campbell | F04D 29/426 |
| 2002/0012583 | A1 * | 1/2002 | Hesse | F04D 15/0038 415/47 |
| 2002/0192072 | A1 * | 12/2002 | Kardasz | F04D 15/0038 415/127 |
| 2018/0149171 | A1 * | 5/2018 | Geffert | F01P 5/12 |

* cited by examiner

COOLANT PUMP, COOLING SYSTEM PROVIDED WITH THE SAME FOR VEHICLE AND CONTROL METHOD FOR THE SAME

CROSS-REFERENCE TO RELATED APPLICATION

This application claims priority to and the benefit of Korean Patent Application No. 10-2018-0090816, filed on Aug. 3, 2018, which is incorporated herein by reference in its entirety.

FIELD

The present disclosure relates to a coolant pump, a cooling system provided with the coolant pump and a control method for the cooling system according to a driving condition of a motor vehicle.

BACKGROUND

The statements in this section merely provide background information related to the present disclosure and may not constitute prior art.

An engine discharges thermal energy while generating torque based on combustion of fuel, and a coolant absorbs thermal energy while circulating through the engine, a heater and a radiator, and releases the thermal energy to the outside.

When a temperature of the coolant of the engine is low, viscosity of oil may increase frictional force and fuel consumption, and a temperature of an exhaust gas may increase gradually to lengthen a time for a catalyst to be activated, which degrades quality of the exhaust gas. In addition, as a time taken for a function of the heater to be normalized is increased, a driver of the vehicle may feel discomfort.

When the coolant temperature is excessively high, we have discovered that knocking is occurred, and performance of the engine may be deteriorated by adjusting ignition timing in order to suppress the knocking. In addition, when a temperature of a lubricant is excessively high, a viscosity of the lubricant is lowered and the lubrication performance may be deteriorated.

Accordingly, a multi-stage control water pump for controlling several cooling elements, such as keeping the high temperature of the coolant for a certain part of the engine and keeping the low temperature of the coolant for other part of the engine has been developed. The multi-stage control water pump may control flow amount so that warm-up time of the engine may be reduced and fuel efficiency may be enhanced.

However, we have discovered that the coolant must be flowed, when a heater or an LP-EGR cooler is operated in a cool driving condition. Accordingly, warm-up time of the engine may be increased and fuel efficiency may be deteriorated.

The above information disclosed in this Background section is only for enhancement of understanding of the background of the present disclosure, and therefore it may contain information that does not form the prior art that is already known to a person of ordinary skill in the art.

SUMMARY

The present disclosure provides to a coolant pump, a cooling system provided with the same and a control method for the same having advantages of reducing responding time according to a driving condition.

A coolant pump for a vehicle according to an exemplary form of the present disclosure may include an impeller mounted at one side of a shaft and configured for pumping a coolant, a pulley mounted at the other side of the shaft and configured for receiving a torque, a pump housing including an inlet for allowing the coolant to flow in and an outlet for allowing the coolant to flow out, a shroud disposed within the pump housing for selectively closing or opening the outlet and an operation portion selectively moving the shroud.

The shroud may be formed as a cylindrical shape and a control passage is formed diagonally to an external circumference of the shroud, and the shroud may rotate along a circumferential direction of the shroud according to an operation of the operation portion.

The operation portion may include a driving motor and an intermediating gear engaged with the driving motor for rotating the shroud according to a rotation of the driving motor.

According to other form of the present disclosure, the operation portion may include a solenoid for rotating the shroud.

According to other form of the present disclosure, the shroud may be formed as a cylindrical shape, and the shroud may move along a longitudinal direction of the shroud according to an operation of the operation portion.

The operation portion may include a driving motor and an intermediating gear engaged with the driving motor for moving the shroud according to a rotation of the driving motor.

According to other form of the present disclosure, the operation portion may include a solenoid for moving the shroud.

A cooling system according to an exemplary form of the present disclosure may include an engine block, a cylinder head connected with the engine block, a plurality of heat exchange elements, a coolant pump transmitting a coolant to the engine block, the cylinder head and the plurality of heat exchange elements, a plurality of coolant lines connecting the engine block, the cylinder head, the plurality of heat exchange element and the coolant pump, a vehicle operation state detecting portion including a coolant temperature sensor detecting a coolant temperature and outputting corresponding signals and a controller. In addition, the coolant pump may include an impeller mounted at one side of a shaft and configured for pumping the coolant, a pulley mounted at the other side of the shaft and configured for receiving a torque, a pump housing including an inlet for allowing the coolant to flow in and an outlet for allowing the coolant to flow out, a shroud disposed within the pump housing for selectively closing or opening the outlet and an operation portion selectively moving the shroud, and the controller may control an operation of the operation portion according to the corresponding output signals of the vehicle operation state detecting portion.

The shroud may be formed as a cylindrical shape and a control passage is formed diagonally to an external circumference of the shroud, and the shroud may rotate along a circumferential direction of the shroud according to an operation of the operation portion.

The operation portion may include a driving motor and an intermediating gear engaged with the driving motor for rotating the shroud according to a rotation of the driving motor.

According to other form of the present disclosure, the operation portion may include a solenoid for rotating the shroud.

According to other form of the present disclosure, the shroud may be formed as a cylindrical shape, and the shroud may move along a longitudinal direction of the shroud according to an operation of the operation portion.

The operation portion may include a driving motor; and an intermediating gear engaged with the driving motor for moving the shroud according to a rotation of the driving motor.

According to other form of the present disclosure, the operation portion may include a solenoid for moving the shroud.

A control method for the cooling system according to an exemplary form of the present disclosure may include determining, by the controller, whether the output signals of the vehicle operation state detecting portion satisfy a predetermined cold driving condition and controlling, by the controller, the operation of the operation portion for the shroud to close the outlet completely.

The control method may further include determining, by the controller, whether the output signals of the vehicle operation state detecting portion satisfy a predetermined warm driving condition and controlling, by the controller, the operation of the operation portion for the shroud to partially open the outlet.

The control method may further include determining, by the controller, whether the output signals of the vehicle operation state detecting portion satisfy a predetermined high temperature driving condition and controlling, by the controller, the operation of the operation portion for the shroud to open the outlet completely.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
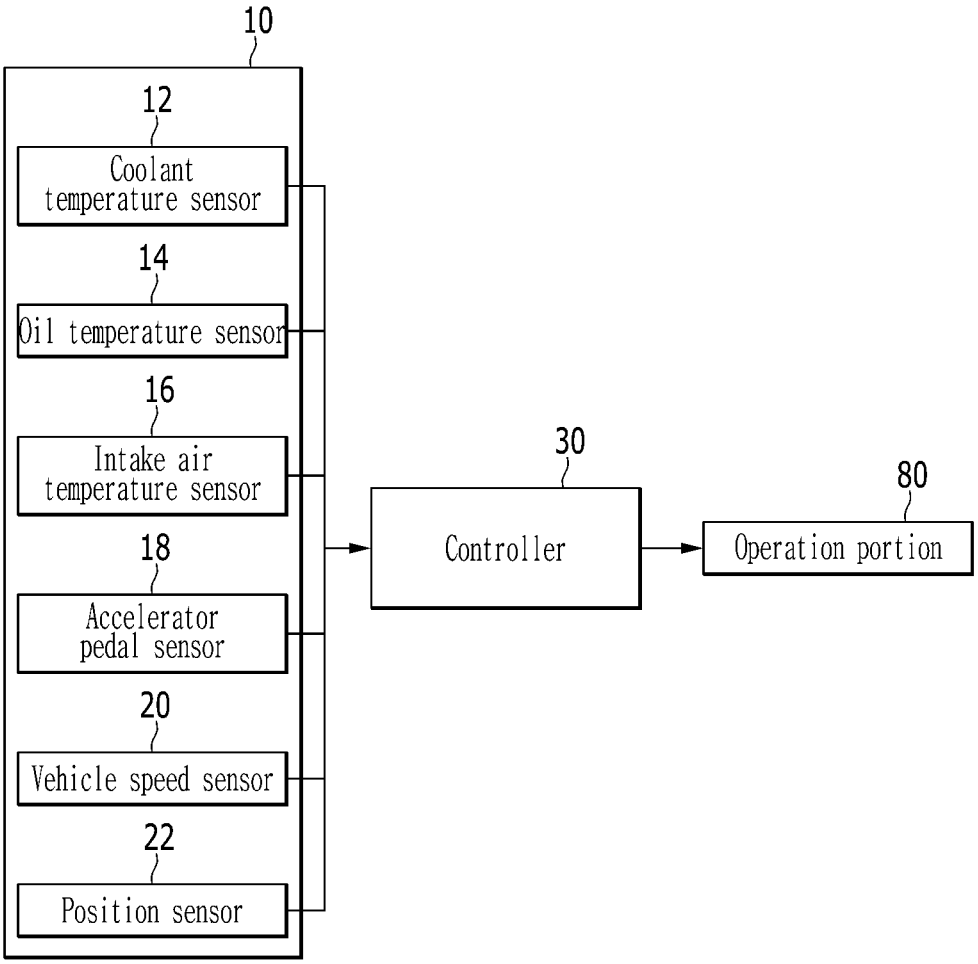
FIG. 1 is a block diagram of a cooling system including a coolant pump according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The sizes and thicknesses of the configurations shown in the drawings are provided selectively for the convenience of description, such that the present disclosure is not limited to those shown in the drawings and the thicknesses are exaggerated to make some parts and regions clear.

However, parts irrelevant to the description will be omitted to clearly describe the exemplary forms of the present disclosure, and the same or similar constituent elements will be designated by the same reference numerals throughout the specification.

In the following description, names of constituent elements are classified as a first . . . , a second . . . , and the like so as to discriminate the constituent elements having the same name, and the names are not necessarily limited to the order.

FIG. 1 is a block diagram of a cooling system including a coolant pump according to an exemplary form of the present disclosure.

Referring to FIG. 1, a cooling system according to an exemplary form of the present disclosure includes a vehicle operation state detecting portion 10, an operation portion 80 and a controller 30 controlling an operation of the operation portion 80 according to output signals of the vehicle operation state detecting portion 10. The controller 30 may be implemented as one or more microprocessors operating by a predetermined program, and the predetermined program may include a series of commands for performing the exemplary form of the present disclosure.

The vehicle operation state detecting portion 10 includes a coolant temperature sensor 12 detecting a temperature of coolant and outputting a corresponding signal, an oil temperature sensor 14 detecting a temperature of oil and outputting a corresponding signal, an intake air temperature sensor 16 detecting a temperature of air flowing into an engine and outputting a corresponding signal, an accelerator pedal sensor 18 detecting an angle of an accelerator pedal and outputting a corresponding signal, a vehicle speed sensor 20 detecting a speed of a vehicle and outputting a corresponding signal and a position sensor 22.

Figure 2:
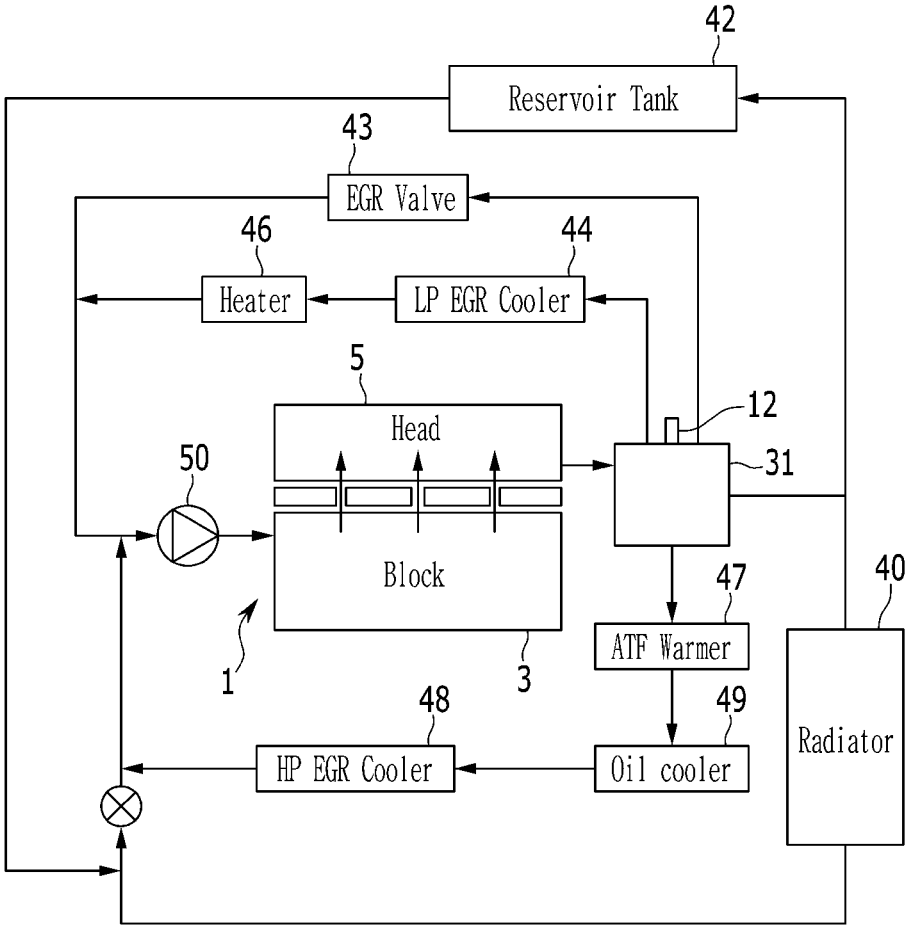
FIG. 2 is a schematic diagram of a cooling system including a coolant pump according to an exemplary form of the present disclosure.

FIG. 2 is a schematic diagram of a cooling system including a coolant pump according to an exemplary form of the present disclosure.

Referring to FIG. 2, the cooling system further includes an engine 1 including an engine block 3 and a cylinder head 5 connected with the engine block 3, a plurality of heat exchange elements, a coolant pump 50 transmitting coolant to the engine block 3, the cylinder head 5 and the plurality of heat exchange elements, and a plurality of coolant lines connecting the engine block 3, the cylinder head 5, the plurality of heat exchange elements and the coolant pump 50.

The plurality of heat exchange elements may include, for example, a radiator 40, an exhaust gas recirculation (EGR) valve 43, a LP-EGR cooler 44, a heater 46, an automatic transmission fluid (ATF) warmer 47, an oil cooler 49, an HP-EGR cooler 48 and so on, but are not limited thereto. A reservoir tank 42 is disposed for receiving a part of coolant to be supplied to the radiator 40 and for removing bubble of the coolant.

The coolant supplied from the coolant pump 50 is transmitted to an outlet pitting 31 through the engine 1, is distributed to the heat exchange elements and then flows into the coolant pump 50.

Figure 3:
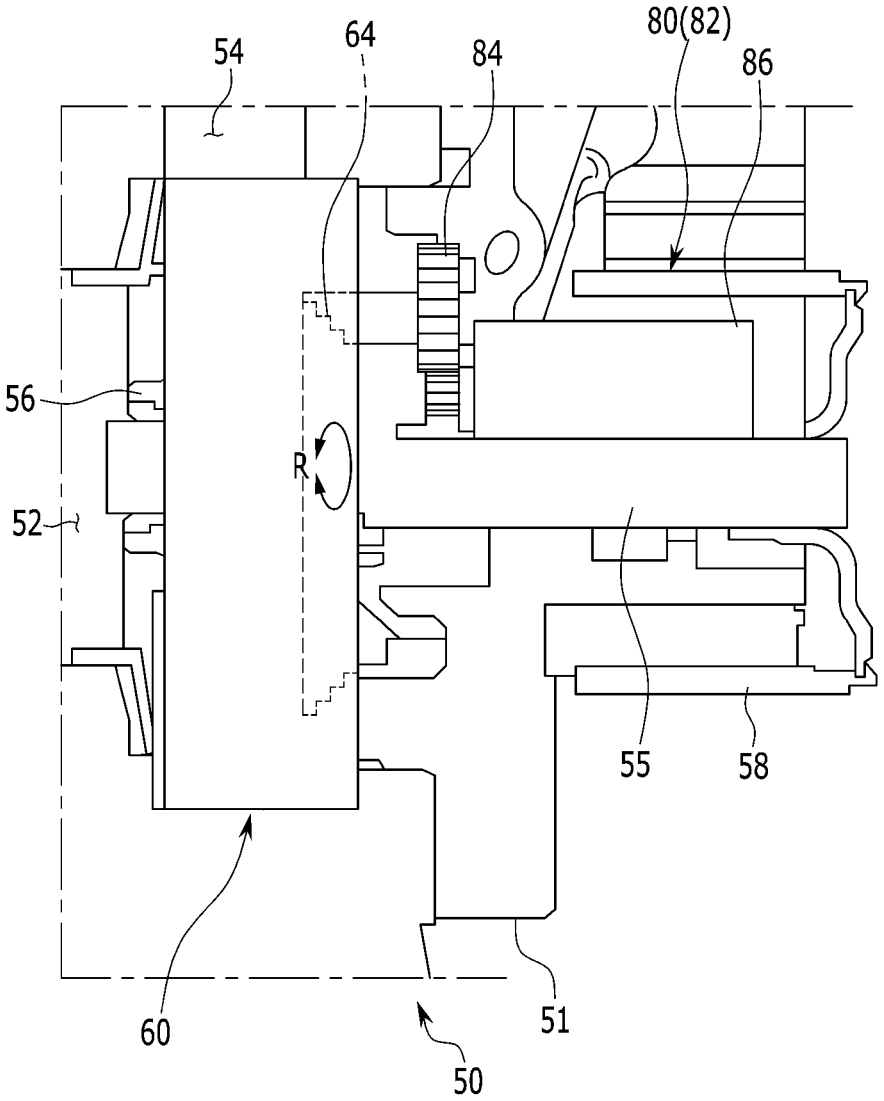
FIG. 3 to FIG. 5 are cross-sectional views showing a coolant pump according to an exemplary form of the present disclosure.
Figure 4:
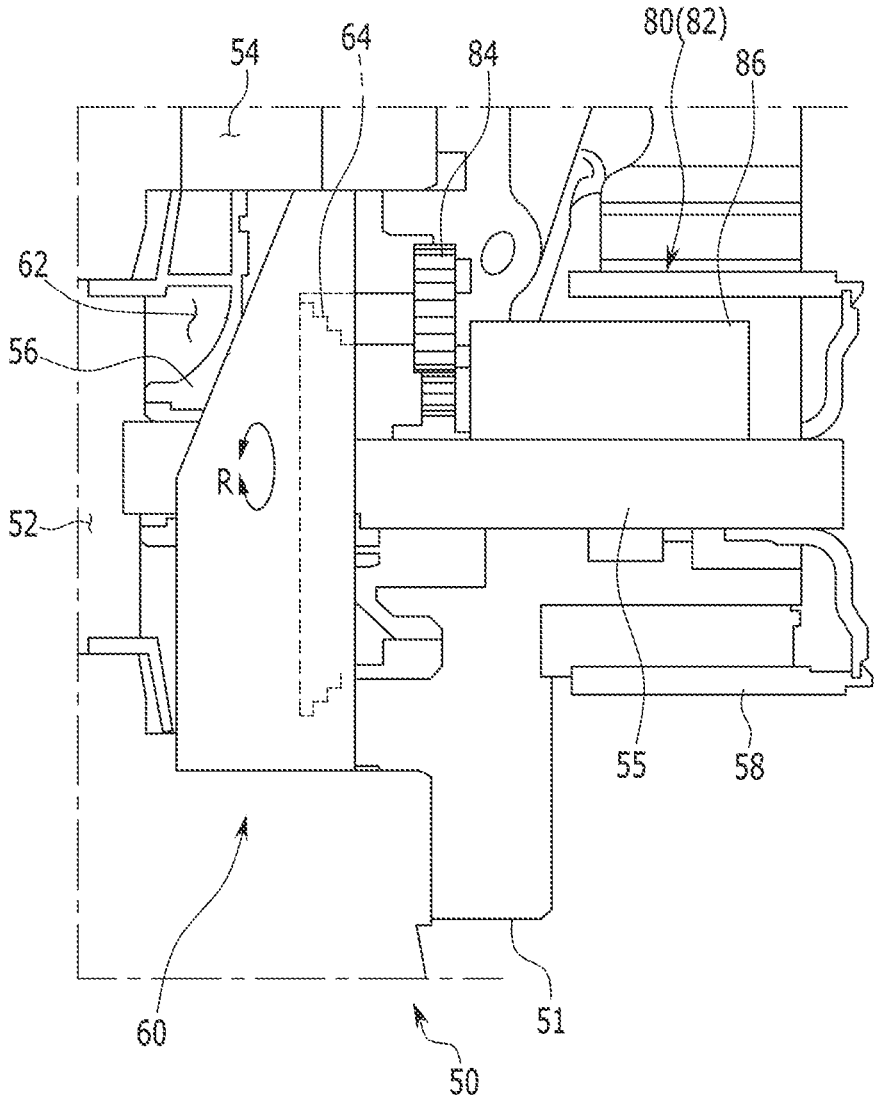
Figure 5:
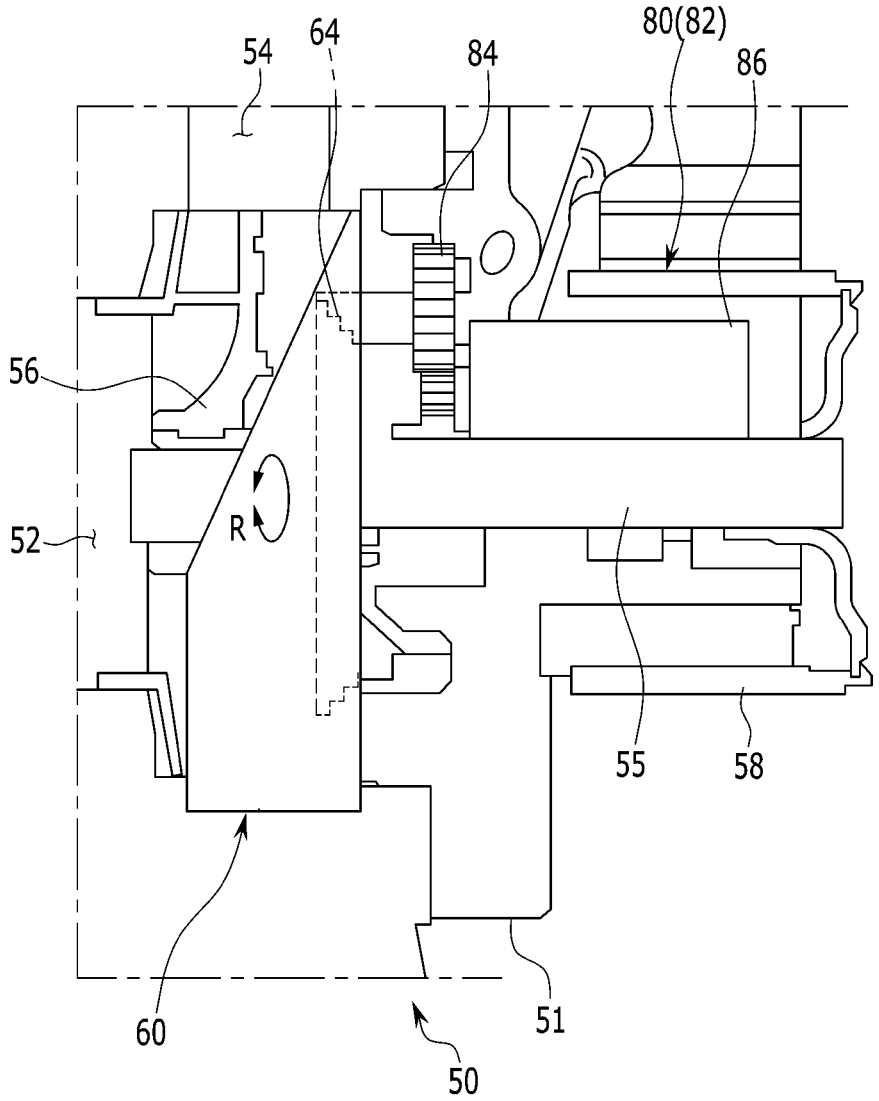

FIG. 3 to FIG. 5 are cross-sectional views showing a coolant pump according to an exemplary form of the present disclosure.

Referring to FIG. 1 to FIG. 5, the coolant pump 50 includes an impeller 56 mounted at one side of a shaft 55 for pumping a coolant, a pulley 58 mounted at the other side of the shaft 55 for receiving a torque, a pump housing 51 including an inlet 52 for allowing the coolant to flow in and an outlet 54 for allowing the coolant to flow out, a shroud 60 disposed within the pump housing 51 for selectively closing or opening the outlet 54 and the operation portion 80 for selectively moving the shroud 60.

The position sensor 22 is mounted to the pump housing 51, detects a position of the shroud 60 and outputs a corresponding signal. The pulley 58 receives a torque from an output shaft of the engine 1 for rotating the shaft 55. The shroud 60 may be formed as a cylindrical shape and a control passage 62 is formed diagonally to an external circumference of the shroud 60. The shroud 60 may rotate along a circumferential direction R of the shroud 60 according to an operation of the operation portion 80.

The operation portion 82 as shown in FIG. 3 to FIG. 5 includes a driving motor 86 and an intermediating gear 84 engaged with the driving motor 86, and the intermediating gear 84 rotates the shroud 60 according to a rotation of the driving motor 86. For example, an one end of the intermediating gear 84 may be formed as a spur gear engaged with the driving motor 86, a shroud gear 64 may be formed to an inside of the shroud 60 and the other end of the intermediating gear 84 may be engaged with the shroud gear 64. For example, the other end of the intermediating gear 84 and the shroud gear 64 may be bevel gears and the shroud 60 may rotates along the circumferential direction R thereof according to a rotation of the intermediating gear 84.

As shown in FIG. 3 to FIG. 5, the outlet 54 closed by the shroud 60 may be opened and the coolant may flow out through the control passage 62 when the driving motor 86 is actuated to rotate the shroud 60. Accordingly, amount of the coolant flowed out through the outlet 54 may be controlled according to the rotation of the driving motor 86.

Figure 6:
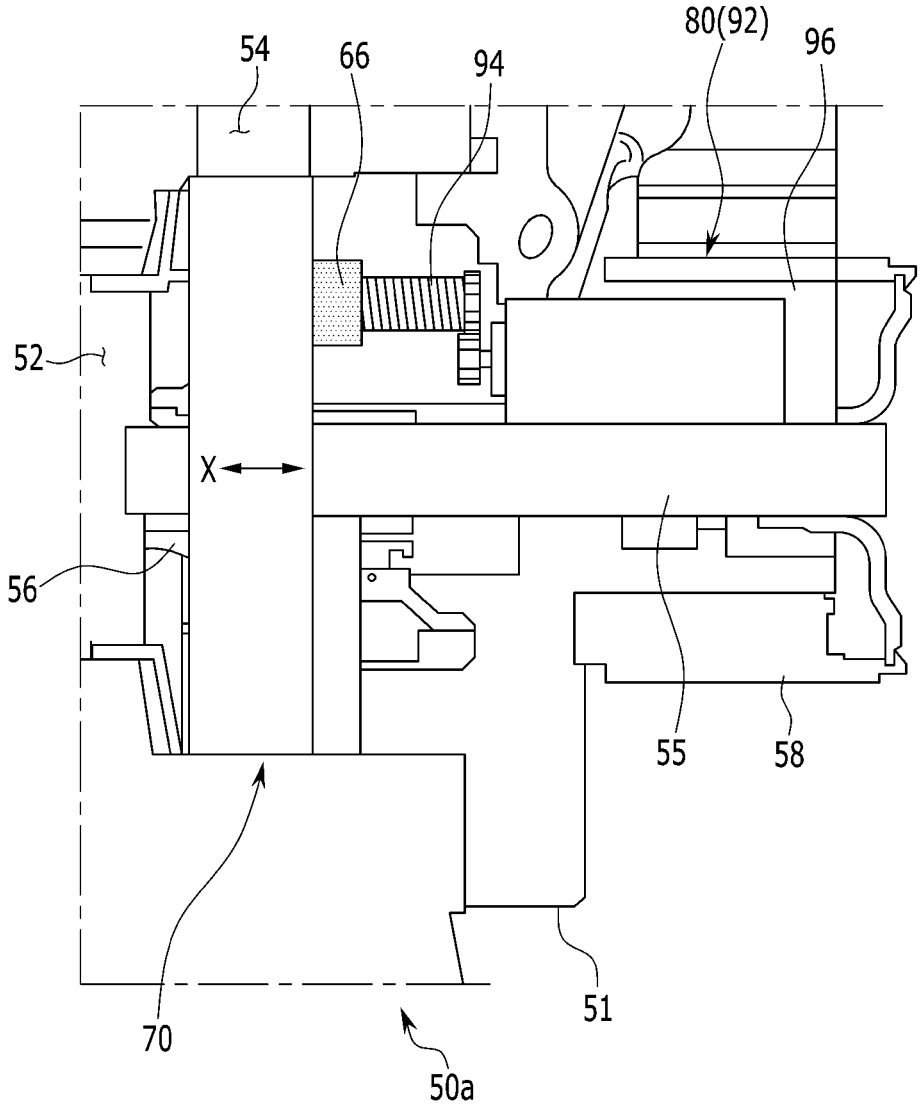
FIG. 6 to FIG. 8 are cross-sectional views showing a coolant pump according to another exemplary form of the present disclosure.
Figure 7:
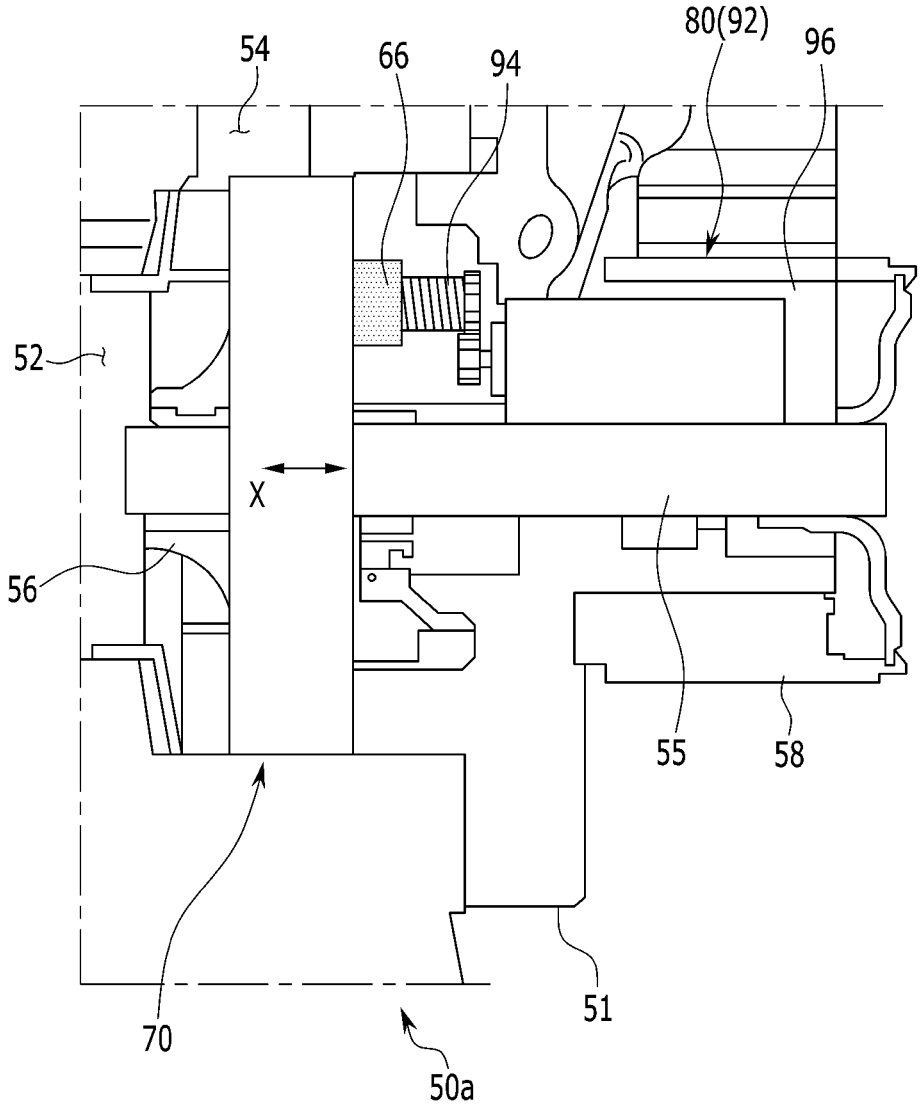
Figure 8:
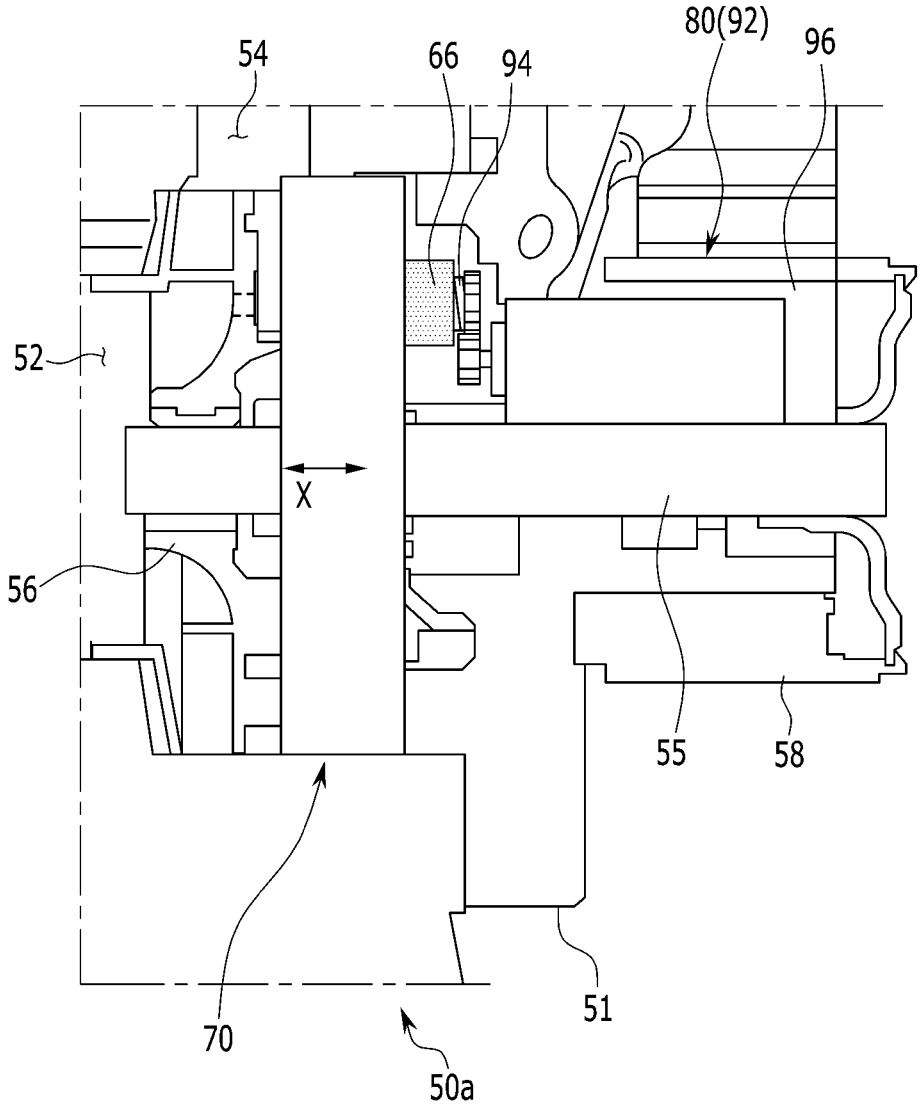

FIG. 6 to FIG. 8 are cross-sectional views showing a coolant pump according to another exemplary form of the present disclosure.

In description of the coolant pump shown in FIG. 6 to FIG. 8, the same or similar constituent elements described in FIG. 3 to FIG. 5 will be designated by the same reference numerals and repeated descriptions will be omitted.

A coolant pump 50*a* shown in FIG. 6 to FIG. 8 includes a shroud 70 formed as a cylindrical shape, and the shroud 70 may move along a longitudinal direction X thereof according to an operation of an operation portion 80 (92).

The operation portion 92 shown in FIG. 6 to FIG. 8 includes a driving motor 96 and an intermediating gear 94 engaged with the driving motor 96, and the intermediating gear 94 moves the shroud 70 according to a rotation of the driving motor 96.

For example, the intermediating gear 94 is engaged with the driving motor 96 and a shroud block 66 connected with the shroud 70 is engaged with the intermediating gear 94. In addition, an end of the intermediating gear 94 may be formed as a spur gear engaged with the driving motor 86 and a screw thread engaged with the intermediating gear 84 may be formed to inside of the shroud block 66. And the shroud 70 may move along the longitudinal direction X thereof according to a rotation of the intermediating gear 84.

As shown in FIG. 6 to FIG. 8, the outlet 54 closed by the shroud 70 may be opened according to a rotation of the driving motor 96. The amount of the coolant flowed out through the outlet 54 may be controlled according to a rotation of the driving motor 96.

Figure 9:
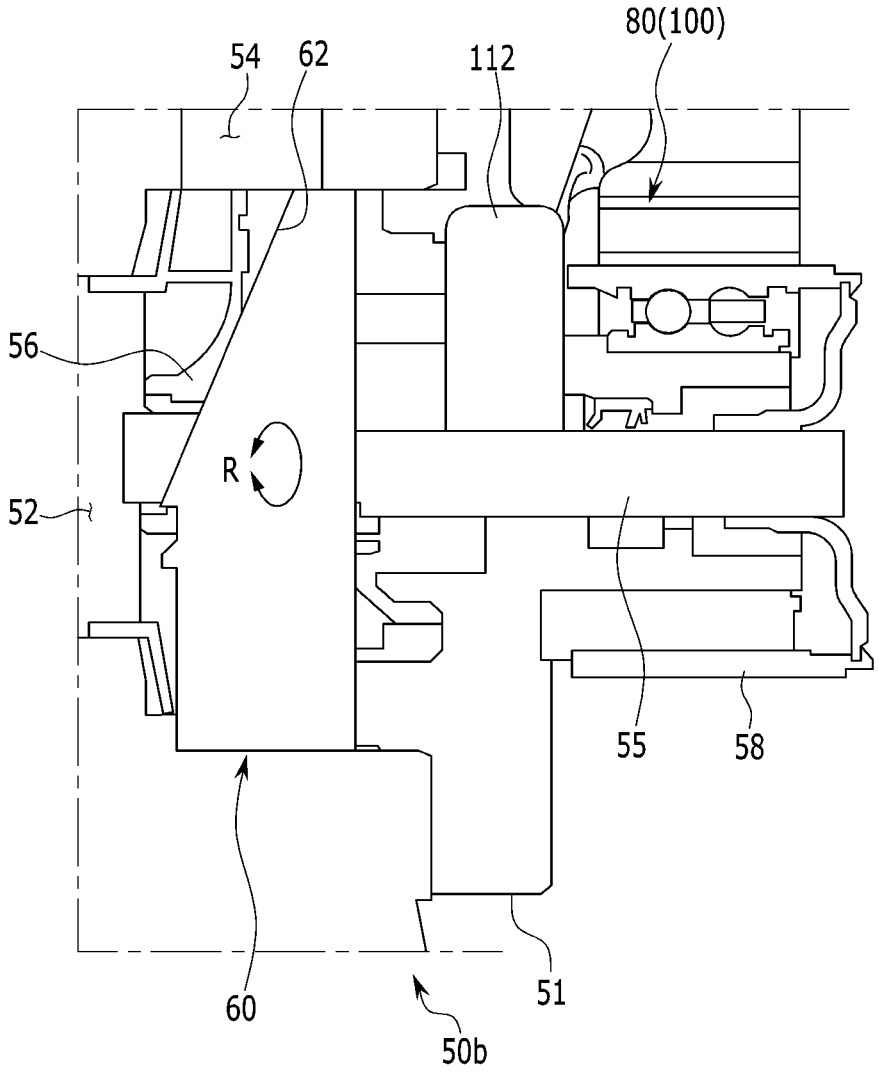
FIG. 9 and FIG. 10 are cross-sectional views showing a coolant pump according to variant exemplary form of the present disclosure.
Figure 10:
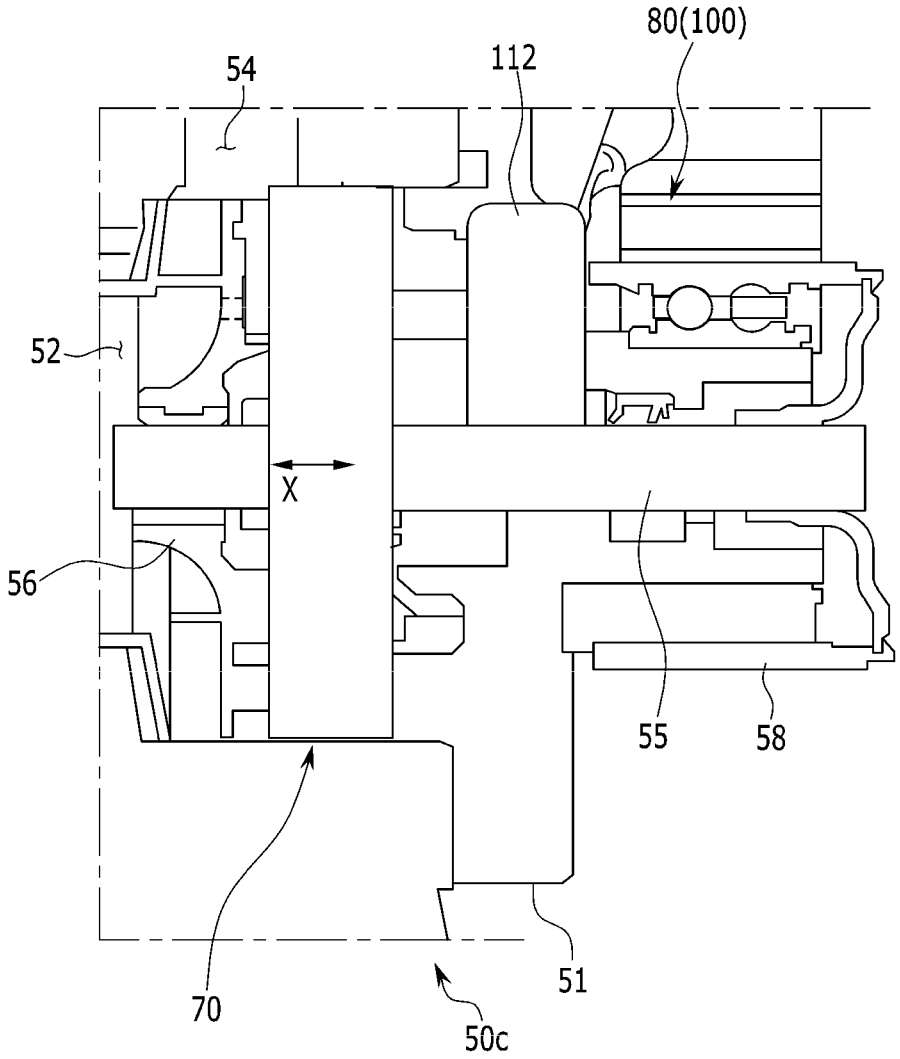

FIG. 9 and FIG. 10 are cross-sectional views showing a coolant pump according to variant exemplary form of the present disclosure.

In description of the coolant pump shown in FIG. 9 and FIG. 10, the same or similar constituent elements described in FIG. 3 to FIG. 8 will be designated by the same reference numerals and repeated descriptions will be omitted.

A coolant pump 50*b* shown in FIG. 9 includes a shroud 60 formed as a cylindrical shape and the shroud 60 may be moved according to an operation of the operation portion 80 (100).

As shown in FIG. 9, the coolant pump 50*b* includes the operation portion 100 provided with a solenoid 112 for rotating the shroud 60 with the control passage 62 shown in FIG. 3 to FIG. 5, and opening of the outlet 54 may be controlled by rotating the shroud 60 according to an operation of the solenoid 112.

As shown in FIG. 10, a shroud 70 is provided to coolant pump 50*c*, and the solenoid 112 may move the shroud along the longitudinal direction X thereof to control opening of the outlet 54.

Operations of the solenoid 112 are the same as the exemplary forms provided with the motor and the intermediating gear, and thus repeated descriptions will be omitted.

A control method for a cooling system may be applied to various exemplary forms of the cooling system described above in the present disclosure.

The controller 30 determines whether the output signals of the vehicle operation state detecting portion 10 satisfy a predetermined cold driving condition, and if the cold driving condition is satisfied, the controller 30 controls an operation of the operation portion 80 for completely closing the outlet 54 of the shroud 60 or 70 as shown in FIG. 3 and FIG. 6. The predetermined cold driving condition may be preset as the output signal of the coolant temperature sensor 12 is less than 50° C. In this case, the outlet 54 is closed completely, so that the entire coolant flow is stopped and warm-up time of the engine 1 may be reduced.

The controller 30 determines whether the output signals of the vehicle operation state detecting portion 10 satisfy a predetermined warm driving condition and if the warm driving condition is satisfied, the controller 30 controls the operation of the operation portion 80 for partially opening the outlet 54 of the shroud 60 or 70. When the coolant temperature as shown in FIG. 4, FIG. 7 and FIG. 9 is increased, the controller 30 controls the operation of the operation portion 80 for opening the outlet 54. Accordingly, the amount of the outlet 54 is controlled according to the output signals of the vehicle operation state detecting portion 10 and may be preset by experiments.

The controller 30 determines whether the output signals of the vehicle operation state detecting portion 10 satisfy a predetermined high temperature driving condition and if the high temperature driving condition is satisfied, the controller 30 controls the operation of the operation portion 80 for completely opening the outlet 54 of the shroud 60 or 70. The predetermined high temperature driving condition may be preset as the output signal of coolant temperature sensor 12 is higher than 100° C. In this case, the outlet 54 is opened completely, so that cooling performance may be increased.

As described above, the coolant pump, the cooling system provided with the same and the control method for the same according to various exemplary forms of the present disclosure may control the responding time according to a driving condition.

While this present disclosure has been described in connection with what is presently considered to be practical exemplary forms, it is to be understood that the present disclosure is not limited to the disclosed forms, but, on the contrary, it is intended to cover various modifications and equivalent arrangements included within the spirit and scope of the present disclosure.

<Description of symbols>

| | |
|---|---|
| 1: engine | 3: engine block |
| 5: cylinder head | |
| 10: vehicle operation state detecting portion | |
| 12: coolant temperature sensor | 14: oil temperature sensor |
| 16: intake air temperature sensor | 18: accelerator pedal sensor |
| 20: vehicle speed sensor | 22: position sensor |
| 30: controller | 31: outlet pitting |
| 40: radiator | 42: reservoir tank |
| 44: LP-EGR cooler | 46: heater |
| 47: ATF warmer | 48: HP-EGR cooler |
| 49: oil cooler | 50: water pump |
| 51: pump housing | 52: inlet |
| 54: outlet | 55: shaft |
| 56: impeller | 58: pulley |
| 60, 70: shroud | 62: control passage |
| 64: shroud gear | 66: shroud block |
| 80: operation portion | 84, 94: intermediating gear |
| 86, 96: driving motor | 112: solenoid |

What is claimed is:

1. A coolant pump for a vehicle comprising:

an impeller mounted at one side of a shaft and configured for pumping a coolant;

a pulley mounted at an other side of the shaft and configured for receiving a torque;

a pump housing including an inlet for allowing the coolant to flow in and an outlet for allowing the coolant to flow out;

a shroud disposed within the pump housing for selectively closing or opening the outlet; and an operation portion selectively moving the shroud, wherein:

the shroud is formed as a cylindrical shape and includes a slanted surface formed on an outer surface of the shroud, the slanted surface and an inner surface of the pump housing is configured to form a control passage diagonally extended from the inlet to the outlet of the pump housing, and when the shroud rotates inside the inner surface of the pump housing along a circumferential direction of the shroud, the control passage is open to the outlet or closed.

2. The coolant pump of claim 1, wherein the operation portion includes:

a driving motor; and an intermediating gear engaged with the driving motor for rotating the shroud according to a rotation of the driving motor.

3. A cooling system comprising:

an engine block;

a cylinder head connected with the engine block;

a plurality of heat exchange elements;

a coolant pump transmitting a coolant to the engine block, the cylinder head and the plurality of heat exchange elements;

a plurality of coolant lines connecting the engine block, the cylinder head, the plurality of heat exchange elements and the coolant pump;

a vehicle operation state detecting portion including a coolant temperature sensor detecting a coolant temperature and outputting corresponding signals; and a controller, and wherein the coolant pump includes:

an impeller mounted at one side of a shaft and configured for pumping the coolant;

a pulley mounted at an other side of the shaft and configured for receiving a torque;

a pump housing including an inlet for allowing the coolant to flow in and an outlet for allowing the coolant to flow out;

a shroud disposed within the pump housing for selectively closing or opening the outlet; and an operation portion selectively moving the shroud, wherein the controller controls an operation of the operation portion according to the corresponding output signals of the vehicle operation state detecting portion, and wherein:

the shroud is formed as a cylindrical shape and includes a slanted surface formed on an outer surface of the shroud, the slanted surface and an inner surface of the pump housing is configured to form a control passage diagonally extended from the inlet to the outlet of the pump housing, and when the shroud rotates inside the inner surface of the pump housing along a circumferential direction of the shroud, the control passage is open to the outlet or closed.

4. The cooling system of claim 3, wherein the operation portion includes:

a driving motor; and an intermediating gear engaged with the driving motor for rotating the shroud according to a rotation of the driving motor.

5. A control method for the cooling system of claim 3, comprising determining, by the controller, whether the output signals of the vehicle operation state detecting portion satisfy a predetermined cold driving condition; and in response to determining that the output signals satisfy the predetermined cold driving condition, rotating the shroud, by the operation of the operation portion, and completely closing the outlet by an unslanted portion of a circumference surface of the shroud.

* * * * *